United States Patent [19]

Vosbikian et al.

[11] 4,120,242

[45] Oct. 17, 1978

[54] BULKY MATERIAL COMPACTER

[76] Inventors: Joseph Vosbikian, 617 Ashmead Rd., Cheltenham, Pa. 19012; John R. Kalalian, 1004 Shadeland Ave., Drexel Hill, Pa. 19026

[21] Appl. No.: 846,438

[22] Filed: Oct. 28, 1977

[51] Int. Cl.[2] ..... B30B 5/04

[52] U.S. Cl. ..... 100/212; 5/343; 24/269

[58] Field of Search ..... 5/343; 100/212, 87, 100/76, 40, 278, 211; 24/68 D, 71.2, 269

[56] References Cited

U.S. PATENT DOCUMENTS

| | | | |
|---|---|---|---|
| 402,776 | 5/1889 | Sparks | 24/269 |
| 1,704,182 | 3/1929 | Ellery | 5/343 |
| 1,987,318 | 1/1935 | Backenecker | 100/212 |
| 2,448,288 | 8/1948 | Alk | 100/212 X |

FOREIGN PATENT DOCUMENTS

| | | | |
|---|---|---|---|
| 53,042 | 11/1922 | Sweden | 100/212 |

*Primary Examiner*—Billy J. Wilhite

*Attorney, Agent, or Firm*—Weiser, Stapler & Spivak

[57] ABSTRACT

A compacter for maintaining compressible items in a tightly wrapped condition to make them easily transportable is particularly useful by campers and backpackers to wrap items of bedding, such as sleeping bags, mattresses, foam rubber pads, blankets, and the like. The compacter includes a flexible and durable strap for encircling the item to be compacted with the end margins of the strap adjacent to each other. The strap is rolled up from the end margins on an elongate, rod-like section of a rigid winder to tighten the strap about the material to be compacted. The winder includes a lever section that extends transversely of the rod-like section to provide a mechanical advantage for rolling up the strap. After the strap has been rolled up a latching device is connected to the lever section to prevent it from rotating to unwind the strap.

13 Claims, 4 Drawing Figures

BULKY MATERIAL COMPACTER

BACKGROUND OF THE INVENTION

This invention relates generally to a compacter for maintaining a bulky compressible item in a tightly rolled condition to make the item more easily transportable. The compacter is particularly useful by campers and backpackers to tightly roll items of bedding, such as sleeping bags, mattresses, foam rubber pads, blankets and the like.

A wide variety of strap-type devices exist in the prior art for clamping or holding a wide variety of different articles. For example, strap-type devices have been used to hold different types of articles on a supporting platform (see U.S. Pat. Nos. 2,852,827 and 2,896,296); to apply a compressive force to opposed platens of a hand press (see U.S. Pat. No. 2,448,288) and to anchor large articles, such as mobile homes, planes or boats (see U.S. Pat. Nos. 3,673,642 and 3,881,694). Although all of these devices include a mechanism for tightening a strap, or band, to either clamp or hold one or more articles, none of these mechanisms are particularly well suited for use in low cost, light weight, easy to operate units of the type that a camper might use to tightly roll up a sleeping bag or similar item, to make it more easily transportable.

U.S. Pat. No. 1,987,318, issued to Backenecker, while directed to art that is completely nonanalogous to the instant invention, does disclose a device employing an apron that is connected at one of its ends to a rotatable rod that is turned by a lever to foreshorten the apron and thereby tighten it about a ham roll. This device is used to shape the ham, and can actually be left on the ham while it is being cooked or cured. When the apron is tightened to the desired degree a rachet wheel and pawl arrangement is provided to prevent it from unwrapping. While the device disclosed by Backenecker may be suited for its intended function, it is bulkier and more complex than is desirable for use in rolling up camping items to make them more easily transportable.

SUMMARY OF THE INVENTION

The compacter of this invention is a low cost, light weight, easy to operate device that is employed to maintain a bulky compressible item in a tightly rolled condition to make the item more easily transportable. The device is advantageously employed by backpackers to tightly roll up sleeping bags and similar items to make them easier to carry.

The compacter includes a flexible and highly durable strap that is placed around the item to be compacted with the end margins of the strap adjacent to each other. The strap is rolled up from these end margins on an elongate, rod-like section of a rigid winder. The winder further includes a lever section extending transversely of the rod-like section to provide a mechanical advantage for rotating the rod-like section, and thereby tighten the strap about the material to be compacted. A latching system is connected to the lever to prevent it from rotating to unwind the strap. Most preferably, the compacter includes a guard positioned between the rod-like section of the winder and the item to be wrapped to prevent the item from winding up on the rod-like winder section. It is preferred that the latching system include a flexible strand bridging the lateral dimension of the strap and being joined at its opposed ends to the guard and lever, respectively.

It is an object of this invention to provide a unique, simple and reliable compacter for maintaining a bulky compressible item in a tightly rolled condition to make the item more easily transportable.

It is a further object of this invention to provide a compacter employing a flexible and durable strap in conjunction with a simple actuating mechanism to tighten the strap about the item to be compacted.

It is a further object of this invention to provide a compacter in which a mechanical advantage is employed to tighten it about an item to be compacted.

It is a further object of this invention to provide a compacter including a strap that is rolled up to tighten it around an item to be compacted.

It is a further object of this invention to provide a compacter having a strap that is rolled up aroundan item to be compacted, and in which the item is prevented from being directed into the rolled section of the strap.

It is a further object of this invention to provide a compacter including a simple and reliable latching system for maintaining a flexible a durable strap in a tightly rolled condition around an item to be compacted.

Other objects and a fuller understanding of the invention will be had by referring to the following description and claims of a preferred embodiment thereof, taken in conjunction with the accompanying drawings, wherein like reference characters refer to similar parts through the several views, and in which:

DESCRIPTION OF THE PREFERRED EMBODIMENTS OF THE INVENTION

Figure 1:
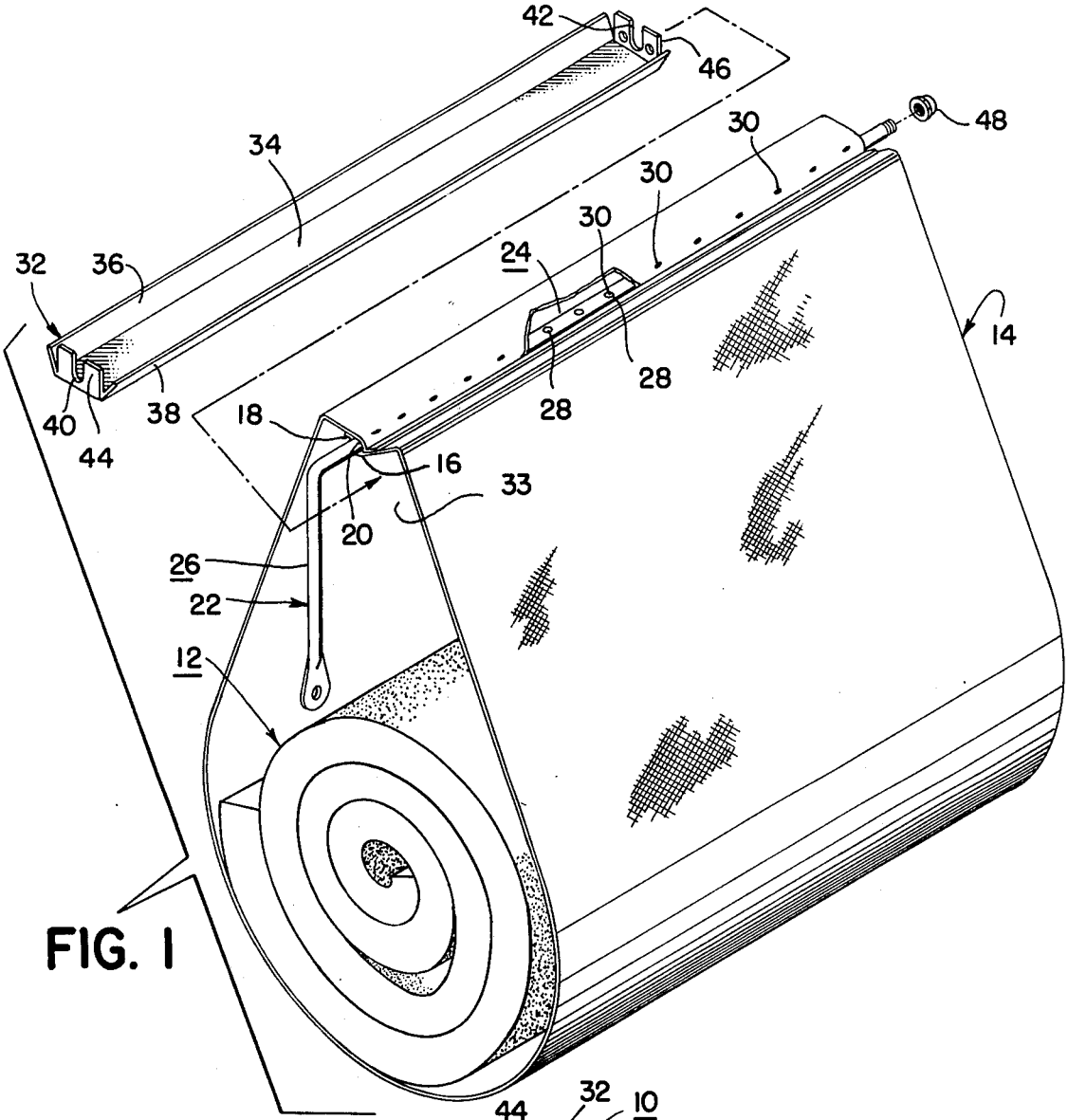
FIG. 1 is partly exploded, perspective view of the compacter of this invention with parts broken away to show details of interior construction.

Although specific terms are used in the following description for the sake of clarity, these terms are intended to refer only to the particular structure of the invention selected for illustration in the drawings, and are not intended to define or limit the scope of the invention.

This invention relates to a compacter 10 for maintaining a bulky, compressible item in a tightly rolled condition to make the item more easily transportable. Although the compacter can be used to roll up many different items, it is primarily intended for use in wrapping up camping items, such as sleeping bags, to make them less bulky, and therefore easier to store or carry. For purposes of illustration, this invention will be described in connection with the compacting, or rolling up of a sleeping bag, designated by the numeral 12 in the drawings.

Referring to FIG. 1, the compacter 10 of this invention includes a strap 14 made of a flexible and highly durable material. For example, the strap can be made of nylon or canvas, and preferably is treated to be water repellant so that the sleeping bag 12 will be maintained in a relatively dry condition in the event it is being carried in the rain. The strap 14 includes opposed, laterally extending end margins 16 and 18 that are overlapped with each other, and the overlapped regions are connected together by spaced apart, laterally extending seams to form a laterally extending loop 20.

Referring specifically to FIG. 1, the compacter 10 includes a rigid winder 22, including an elongate, rod-like section 24 extending completely through the loop 20, and a transversely offset lever section 26 to provide a mechanical advantage to rotate the rod-like section 24. Preferably, the winder 22 is made from aluminum, or other material that will not rust or otherwise corrode when exposed to adverse weather conditions.

Figure 4:
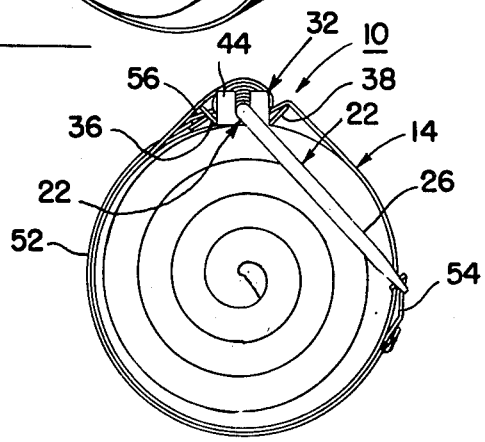
FIG. 4 is an end elevational view of the compacter shown in FIG. 3.

The rod-like section 24 includes a plurality of spaced-apart openings 28 extending through it, and stitching, schematically indicated at 30, is passed through these openings and portions of the strap 14 that form the loop 20 to provide a mechanical connection between the strap and the winder 22. As a result of this connection, the rotation of the winder 22 in a clockwise direction, as indicated by arrow 31 in FIG. 2, will cause the strap 14 to roll up from its end margins 16 and 18 onto the rod-like section 24 to tightly compact the sleeping bag 12, as shown in FIGS. 3 and 4. The winder 22 is rotated through the lever section 26 to establish a mechanical advantage for rotating the rod-like section 24. This permits an extremely tight compaction of the sleeping bag 12 to make it easy to store or carry.

Figure 2:
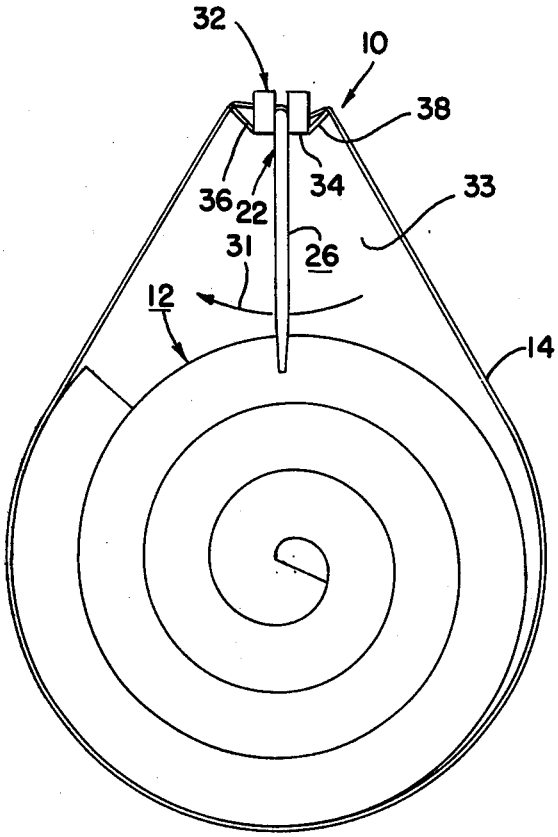
FIG. 2 is an end elevational view of the compacter shown in FIG. 1, but with the parts assembled.
Figure 3:
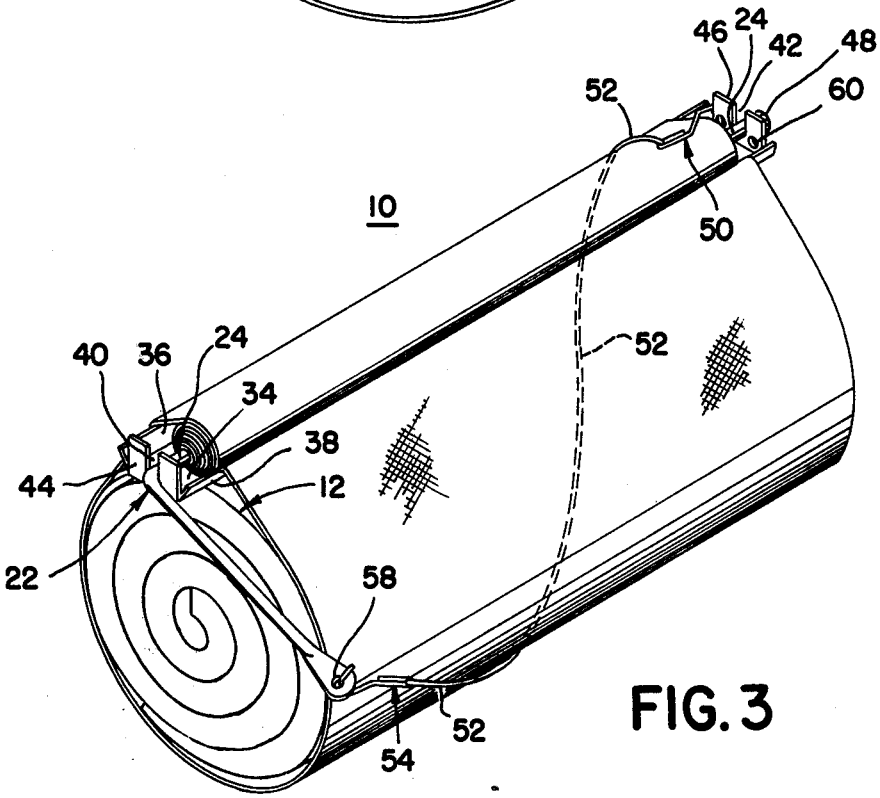
FIG. 3 is a perspective view of the compacter of FIG. 1, but showing it tightly wrapped about an item to be transported, and with its latching system connected to prevent unwrapping.

Referring to FIGS. 1 and 2, the compacter 10 includes a winder guard 32 that is positioned inside the closed area 33 of strap 14, between the rod-like section 24 of the winder 22, and the sleeping bag 12. This guard 32 prevents the sleeping bag 12 from winding up onto the rod-like section 24 of the winder.

Referring to FIG. 1, the winder guard 32 includes a laterally extending central base section 34, and laterally extending flanges 36 and 38 extending upwardly and diverging outwardly from said base section. As can be seen best in FIGS. 2–4, the base section 34 of the winder guard underlies the rod-like section 24 of the winder, and the laterally extending flanges 36 and 38 cooperate with the base 34 to isolate the rod-like section of the winder from the sleeping bag.

Referring to FIGS. 1 and 4, rotatable support for the winder 22 is provided by laterally spaced apart, bearing surfaces 40 and 42. The bearing surfaces 40 and 42 may be U-shaped as illustrated or may be circular openings through which the rod-like section 24 can insert for rotation therewithin. These surfaces are provided in end flanges 44 and 46, respectively, projecting upwardly from the central base section 34 of the winder guard 32. In order to prevent the winder 22 from shifting axially out of the bearing surfaces 40 and 42, a nut 48 is threaded onto the end of the rod-like section 24 opposite the level section 26 to bear against the outer surface of the end flange 46 (FIG. 1). Optionally, the winder 22 can terminate in a plain end and a push nut would be employed to maintain the parts together.

Referring to FIGS. 3 and 4, a latching system 50 is provided to prevent the winder 22 from rotating in a counterclockwise direction, as viewed in FIG. 4, to unwind the strap 14. In other words, the latching system 50 maintains the compacter in its compacting condition. This system includes a flexible strand 52, such as string, rope, cable and similar materials, and hooks 54 and 56 connected to opposed ends of the strand. The strand 52 extends laterally across the strap 14, and the hooks 54 and 56 are engaged, respectively, within opening 58 provided through the lever section 26 of the winder 22, and an opening 60 provide in the upturned end flange 46 of the winder guard 32. It should be apparent that the connection of the strand 52 to the lever section 26 of the winder, as illustrated, will prevent counterclockwise rotation of the winder that would unroll the strap 14. When it is desired to use the sleeping bag 12, the latching system 50 can be disengaged easily to permit the strap 14 to be unwound. Also, it is an extremely simple operation to wind up and latch the compacter 10 when it is desired to store or transport the sleeping bag.

Although the invention has been described with a certain degree of particularity, it is understood that the present disclosure has been made only by way of example and that numerous changes in the details of construction and the combination and arrangement of parts may be resorted to without departing from the scope of the invention.

What is claimed is:

1. A compacter for maintaining a bulky compressible item in a tightly rolled condition to make the item easily transportable, said compacter including:

a flexible strap for encircling the compressible material, said strap having opposed laterally extending end margins adjacent to each other;

a rotatable, rigid winder for use in rolling up the strap from both of its end margins, said winder including an elongate section extending laterally across the strap and about which the strap is rolled up, and a lever section connected to the elongate section to provide a mechanical advantage for rotating the elongate section of the winder to roll up the the strap tightly around the compressible material; and a latching means connected to the lever section of the winder to prevent the winder from turning in a direction to unroll said strap.

2. The compacter of claim 1 wherein the latching means extends laterally across the strap.

3. The compacter of claim 2 wherein the latching means includes a flexible strand extending laterally across the strap and attached to a lever connecting means, said lever connecting means being engageable with the lever to prevent the winder from turning in a direction to unroll the strap.

4. The compacter of claim 3 wherein the lever connecting means is a hook, said lever having a passageway extending through it for receiving said hook.

5. The compacter of claim 1 wherein the laterally extending end margins of the strap are joined together, said strap including a laterally extending loop adjacent the joined end margins for receiving the elongate section of the winder.

6. The compacter of claim 5 wherein the elongate section of the winder is joined to portions of the strap forming the loop.

7. The compacter of claim 1 including a winder guard positioned between the elongate section of the winder and the compressible material to prevent the compressible material from winding up on the elongage section of the winder.

8. The compacter of claim 7 wherein the winder guard extends laterally across the strap.

9. The compacter of claim 8 wherein the winder guard includes a laterally extending central base section underlying the elongate section of the winder, and laterally extending flanges joined to opposed lateral sides of the base section and extending upwardly and diverging outwardly therefrom, said flanges cooperating with the base section to isolate the elongate section of the winder from the compressible material.

10. The compacter of claim 8 wherein the opposed ends of the winder guard include bearing surfaces for rotatably supporting the elongate section of the winder at laterally spaced apart locations.

11. The compacter of claim 9 wherein opposed ends of the winder guard include bearing surfaces for rotatably supporting the elongate section of the winder at laterally spaced apart locations.

12. The compacter of claim 8 wherein the latching means extends laterally across the strap, one end of said latching means being joined to an adjacent end of the winder guard and the opposite end of said latching means being connected to the lever section of the winder.

13. The compacter of claim 9 wherein the latching means extends laterally across the strap, one end of the said latching means being joined to an adjacent end of the winder guard and the opposite end of the said latching means being connected to the lever section of the winder.

* * * * *